United States Patent [19]

Schulte et al.

[11] 4,148,694

[45] Apr. 10, 1979

[54] CONTAINER FOR LOOSE MATERIAL, IN PARTICULAR HOT COAL

[75] Inventors: Fritz Schulte, Meerbusch; Johann G. Riecker, Ratingen; Horst Schröter, Viersen, all of Fed. Rep. of Germany

[73] Assignee: Hartung, Kuhn & Co., Maschinenfabrik GmbH, Dusseldorf, Fed. Rep. of Germany

[21] Appl. No.: 828,914

[22] Filed: Aug. 29, 1977

[30] Foreign Application Priority Data

Sep. 15, 1976 [DE] Fed. Rep. of Germany ..... 2641566

[51] Int. Cl.[2] ..... C10B 31/04

[52] U.S. Cl. ..... 202/262; 55/412; 414/160; 414/147

[58] Field of Search ..... 202/262; 201/40; 214/17 B, 17 C, 18 PH, 35 R; 55/412, 418, 442, 446, 467 (U.S. only); 98/115 R (U.S. only); 141/93 (U.S. only)

[56] References Cited

U.S. PATENT DOCUMENTS

| | | | |
|---|---|---|---|
| 83,506 | 10/1868 | Justi | 55/446 |
| 411,602 | 9/1889 | Miesenhelder et al. | 55/412X |
| 1,215,890 | 2/1917 | Thuneman | 55/412 |
| 1,215,935 | 2/1917 | Hickman | 55/412 |
| 2,075,931 | 4/1937 | Eades | 214/18 PH |
| 3,036,720 | 5/1962 | Malkomes | 214/18 PH |
| 3,522,000 | 7/1970 | Kinney | 55/442 X |
| 3,850,756 | 11/1974 | Rossow | 202/262 |

*Primary Examiner*—Joseph Scovronek
*Assistant Examiner*—Roger F. Phillips
*Attorney, Agent, or Firm*—Dressler, Goldsmith, Clement, Gordon & Shore, Ltd.

[57] ABSTRACT

A container for loose material, in particular for hot coal, during the operation of a coke oven battery including a novel deflecting means for directing particulate matter located in the gas emanating from the loose material back into the container to reduce the flow of particulate matter out of the container to minimize air pollution. The deflecting means is in the shape of an umbrella-shaped guide plate which is adjustable relative to the container to control an annular outlet opening for the gas. In the annular opening are located settling plates to further minimize the flow of particulate matter out of the container.

3 Claims, 1 Drawing Figure

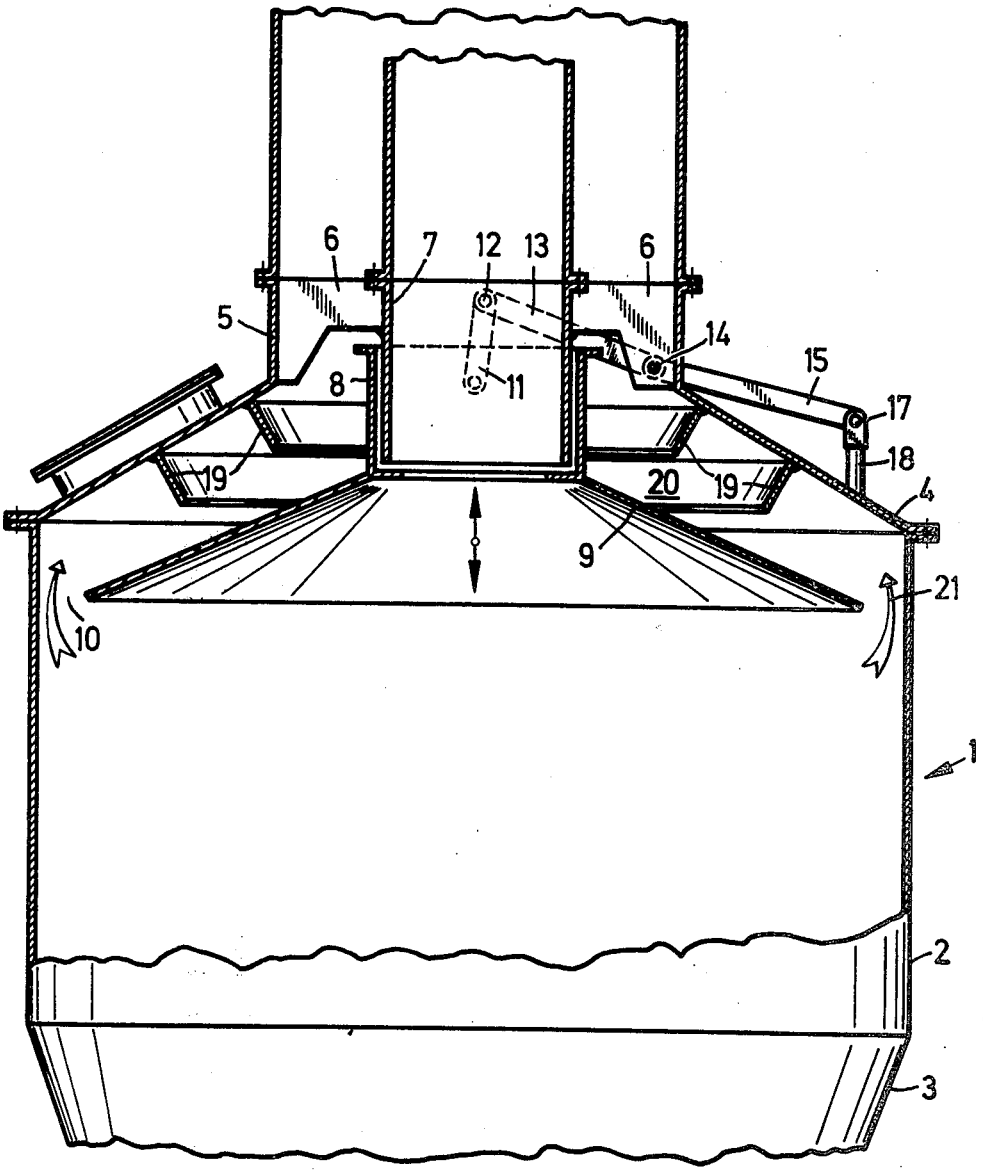
6
7
12
13
6
5
14
15
8
11
17
18
19
20
19
4
9
21
10
1
2
3

CONTAINER FOR LOOSE MATERIAL, IN PARTICULAR HOT COAL

The invention relates to a container for loose material, in particular for hot coal during the operation of a coke oven battery, which container is provided with an upper inlet opening and a lower-funnel-shaped outlet opening for the loose material.

When such containers for loose material, which can, for example, form part of a hopper car which can travel above a coke oven battery or also of coal bunkers for filling the containers located on hopper cars, are filled, the air present in the container is displaced by the coal flowing in. This can lead to extensive emissions of dust into the atmosphere, in particular when the coal is dry or pre-heated. In order to prevent this, it has already been proposed to connect the stationary coal tower to the charging hopper by tight telescopes and to extract and purify the displaced dust-laden gases via stationary pipelines and dust collectors. Since, however, the dust loading of the displaced gases usually is extremely high, high-performance dust-collecting units are necessary which entail high investment costs and operating costs. Furthermore, the high loading of the displaced gases causes dust deposits in the stationary pipelines.

It is the object of the invention to design the initially mentioned known container for loose material in such a way that an intensive pre-settling of the dust-laden gases is possible within the container for loose material, with the aim of recycling the dust of loose material, which has settled out, to the loose material present in the container.

The invention achieves this object by additionally providing the upper side of the container for loose material with a gas extraction opening which is separate from the inlet opening and communicates with the interior of the container via a gas discharge channel which is separate from the filling stream of loose material.

In this way a separation of the loose material flowing in from the gas flowing out is achieved, the stream of gas flowing out being strongly deflected and zones of low dynamic pressure which facilitates settling of the dust thus being formed.

To this end it is is advisable to widen the cross section of the gas discharge channel in the direction of flow of the gases and, furthermore, to design the free cross section of the gas discharge channel to be adjustable.

An intensification of the deflection of the gases laden with dust of loose material can be achieved by means of settling plates which protrude transversely into the free cross section of the discharge channel.

Advantageously, a settling plate can form a valve seat for a movable element in order to adjust the free flow cross section of the gas discharge channel and, according to an appropriate embodiment, this movable adjusting element can form a wall bounding the gas discharge channel, which wall advantageously is designed as an umbrella-shaped guide plate.

According to the present invention, the umbrella-shaped guide plate extends up to the inside of the container wall while leaving an annular gap. The umbrella-shaped guide plate slidably surrounds a feed pipe located in the upper side of the container and can be shifted axially by means of an adjustment device. The feed pipe can here be surrounded, at a radial spacing, by a cylindrical gas extraction branch, the lower end of which is joined to a container cover in the shape of a flat cone, the settling plates being fixed to the inside thereof. The settling plates are advantageously annular and in a concentric arrangement relative to the main axis of the container. Advantageously the annular settling plate provided, as viewed in the direction of flow of the gases, behind the annular gap formed by the inner wall of the container and the umbrella-shaped guide plate, forms the seat for the umbrella-shaped guide plate when the latter is in the position in which it blocks the gas discharge channel. In this embodiment, the umbrella-shaped guide plate would be suitably designed to perform this function.

The feed pipe can also be connected to the gas extraction branch of the container by radial web plates aligned parallel to the main axis of the container. A piece of pipe joined to the umbrella-shaped guide plate is mounted, so that it can be shifted vertically, on the outside of the filling pipe. This is accomplished by providing, on its diametrically opposite outsides, pivot bolts, to each of which a strap is hinged, the free end of which is connected by a hinge to the ends of a fork pivotable about a horizontal pivot axis fixed to the container. The lever end opposite the ends of the fork projects outwards through a sealed slot of the container and is hinged to the free end of the piston of a hydraulic control cylinder.

If complete blocking of the gas discharge channel by the umbrella-shaped guide plate abutting on the annular settling plate is not desired or necessary, it is possible, in order to limit the length of stroke of the umbrella-shaped guide plate and hence to limit the free cross section of the gas discharge channel, to provide a radial inner shoulder, which reaches under the lower end of the feed pipe, at the lower end of the piece of pipe which is concentrically joined to the umbrella-shaped guide plate.

Finally, if it is intended to obtain a more extensive separation of the stream of loose material from the gas stream which is to be discharged and is laden with dust of loose material, the radial inner shoulder of the piece of pipe carrying the umbrella-shaped guide plate can be flanged at the upper end of an extension of the feed pipe, which extension projects from the inner shoulder, coaxially to the filling pipe, into the interior of the container. Both of the aforementioned radial inner shoulders would be eliminated in the illustrated embodiment if the umbrella-shaped guide plate were to be moved to block the gas discharge channel.

In the drawing, a container for loose material is generally designated as 1 and its cylindrical container wall 2 continues at its lower end as an outlet funnel 3 which is shown broken off so that its outlet opening for the loose material cannot be seen.

The upper side of the cylindrical container wall 2 carries a cover 4 which has the shape of a flat cone and which is adjoined upwards by a cylindrical gas extraction branch 5. The inside of this gas extraction branch is provided, distributed at intervals over its circumference, with web plates 6, to the inner ends of which a feed pipe 7 for the loose material to be filled into the container for loose material, is fixed coaxially to the central longitudinal axis of the container. On the outside of this feed pipe 7, a piece of pipe 8 is guided, so that it can be shifted, an umbrella-shaped guide plate 9 extending radially outwards from the lower end of the piece of pipe to the vicinity of the inside of the cylindrical container wall 2, an annular gap 10 being left. On the outside of the piece of pipe 8 there are, diametrically opposite, two pivot bolts, to each of which a strap 11 is hinged, the ends of the two straps being hinged at 12 to the ends of a fork 13 which is rigidly joined to a pivot axis 14 which can turn in bearings in the web plates 6. The pivot axis 14 extends outwards through the gas extraction branch and is there rigidly joined to a lever 15, the free end 17 of which is connected by a hinge to the piston rod 18 of a control element, for example, a control cylinder.

Settling plates 19 extend in the direction of the umbrella-shaped guide plate 9 from the inside of the cover 4 in the shape of a flat cone, at right angles to the lateral surface thereof. Appropriately, these settling plates 19 are of an annular design in the present case. Since the cone angle of the umbrella-shaped guide plate 9 is more obtuse than that of the cover 4, the cover 4 and the guide plate 9 enclose a gas discharge channel 20 which, starting from the annular gap 10, increasingly widens in the direction of flow of the arrow 21 so that the velocity of the gases to be discharged is reduced so that, taking into account the deflection of the gas stream, effected by the settling plates 19, the settling of the dusty constituents present therein is promoted. Since the settling plates 19 and the guide plate 9 extend downwards, these dusty constituents will fall onto the upper side of the umbrella-shaped guide plate 9 and, due to gravity, they are conveyed from there through the annular gap 10 to the loose material present in the container.

As an alternative to this embodiment shown, however, it is also conceivable that the guide plate 9, conjointly with the settling plate 19 which is first in the direction of flow of the arrow 21, forms a valve in such a way that the container can be sealed against the outside by pressing the umbrella-shaped guide plate 9 onto this settling plate 19. As aforementioned, this would be permitted if the flanges at the upper and lower ends of plate 8 were eliminated.

An even shaprer separation of the stream of loose material from the gas stream which is to be discharged and is laden with dust can obviously be achieved by means of the extension pipe which is coaxial to the feed pipe.

It can thus be seen that the settled dust of loose material can be recycled again to the loose material present inside the container. The inserts of the container, which are formed by the settling plates and the guide plate, enable the gas stream flowing out to be strongly deflected, zones of low dynamic pressure being formed which facilitate the settling of the dust.

Instead of the concentric arrangement, in the drawing, of the inlet opening for the loose material and of the gas discharge channel, an eccentric arrangement of the channels for the loose material flowing in and the gas flowing out is obviously also conceivable.

It is, of course, intended to cover by the appended claims all such modifications as fall within the true spirit and scope of the invention.

What is claimed is:

1. A container for loose material, in particular for hot coal during the operation of a coke oven battery, which container is provided with an upper inlet opening in the form of a feed pipe concentrically disposed within an adjacent container portion for providing loose material to said container and a lower, funnel-shaped outlet opening for the loose material, the improvement comprising a device for separating particulate matter from the gas emanating from the coke oven including a deflecting mechanism in the form of an umbrella-shaped guide plate which includes a cylindrical section surrounding said feed pipe for the material laden gas, said deflecting mechanism forming with an adjacent container wall an annular discharge channel from said container that widens in the direction of the flow of gases from said container, adjusting means connected to said container for moving said umbrella plate relative to said feed pipe to control the cross-sectional area of said annular discharge channel and settling plates disposed in said annular discharge channel for deflecting particulate material in the gas stream passing through said channel back into said container.

2. A container as set forth in claim 1 in which the feed pipe is connected to the adjacent container portion by radial web plates disposed parallel to the main axis of the container and the means for adjustably mounting the umbrella-shaped plate relative to the feed pipe consists of bolt means secured to said umbrella-shaped member and a hinge and fork means pivotally secured to said container, one portion of which is pivotable about a horizontal pivot axis fixed to the container and the other end is hinged to the free end of the piston of a hydraulic cylinder for controlling the movement of said umbrella-shaped deflecting member.

3. A container for loose material, in particular for hot coal during the operation of a coke oven battery, which container is provided with an upper inlet opening and a lower, funnel-shaped outlet opening for the loose material, the improvement comprising a device for separating particulate matter from the gas emanating from the coke oven including a deflecting mechanism in the form of an umbrella-shaped guide plate which includes a cylindrical section surrounding said feed pipe and disposed concentric therewith, the container further defining a conically shaped portion disposed generally parallel to the umbrella-shaped guide plate for the material laden gas, said deflecting mechanism forming with an adjacent container wall an annular discharge channel from said container that widens in the direction of the flow of gases from said container and annular settling plates disposed in said annular discharge channel in concentric arrangement relative to the main axis of the container and secured to said cone-shaped portion of the container for deflecting particulate material in the gas stream passing through said channel back into said container.

* * * * *